US011072998B2

(12) United States Patent
Rodriguez

(10) Patent No.: US 11,072,998 B2
(45) Date of Patent: Jul. 27, 2021

(54) DOWNHOLE TOOLS, MULTI-LATERAL INTERVENTION SYSTEMS AND METHODS TO DEPLOY A TUBULAR INTO A LATERAL BOREHOLE OF A MULTI-LATERAL WELL

(71) Applicant: Halliburton Energy Services, Inc., Houston, TX (US)

(72) Inventor: Franklin Charles Rodriguez, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

(21) Appl. No.: 16/696,992

(22) Filed: Nov. 26, 2019

(65) Prior Publication Data

US 2021/0156232 A1 May 27, 2021

(51) Int. Cl.
*E21B 41/00* (2006.01)
*E21B 47/14* (2006.01)

(52) U.S. Cl.
CPC ..... *E21B 41/0035* (2013.01); *E21B 47/14* (2013.01)

(58) Field of Classification Search
CPC ... E21B 41/0035; E21B 41/0042; E21B 7/067
See application file for complete search history.

(56) References Cited

U.S. PATENT DOCUMENTS 3,627,356 A * 12/1971 Anderson ..... E21B 7/067 285/118
5,012,877 A 5/1991 Winters et al.
6,244,340 B1 6/2001 McGlothen et al.
6,279,659 B1 8/2001 Brunet
6,527,067 B1 * 3/2003 Ravensbergen .... E21B 41/0035 175/381
7,299,864 B2 11/2007 Pratt et al.
7,513,302 B2 4/2009 Cassidy et al.
7,669,672 B2 3/2010 Brunet et al.
7,984,763 B2 7/2011 Carter et al.
9,394,753 B2 7/2016 Hurtado
2001/0042621 A1 * 11/2001 Leising ..... E21B 41/0035 166/255.1
2014/0190688 A1 7/2014 Cronley et al.

FOREIGN PATENT DOCUMENTS

WO 199403698 2/1994
WO 199809048 3/1998
WO 2014078364 5/2014

OTHER PUBLICATIONS

J. Oberkircher, et al.; "New System Reduces Multilateral Completion Time"; Drilling Contractor; Nov./Dec. 2000; p. 38-39.

* cited by examiner

*Primary Examiner* — D. Andrews
(74) *Attorney, Agent, or Firm* — McGuireWoods LLP

(57) ABSTRACT

The disclosed embodiments include downhole tools, multi-lateral intervention systems and methods to deploy a tubular into a lateral borehole of a multi-lateral well. A downhole tool includes a mandrel having an angulated interior profile along a first side of the mandrel. The downhole tool also includes a nose coupled to a second side of the mandrel. The downhole tool further includes a link having an angulated exterior profile along a first side of the link that is rotatably coupled to the first side of the mandrel. The link is rotatable from a first position to a second position, and wherein the nose tilts at an angle relative to the link while the link is at the second position.

19 Claims, 6 Drawing Sheets

DOWNHOLE TOOLS, MULTI-LATERAL INTERVENTION SYSTEMS AND METHODS TO DEPLOY A TUBULAR INTO A LATERAL BOREHOLE OF A MULTI-LATERAL WELL

BACKGROUND

The present disclose relates generally to downhole tools, multi-lateral intervention systems and methods to deploy a tubular into a lateral borehole of a multi-lateral well.

A lateral borehole is sometimes drilled from a main borehole to improve hydrocarbon production. After the lateral borehole is drilled, production tubing is deployed in both the main borehole and the lateral borehole to increase hydrocarbon production.

BRIEF DESCRIPTION OF THE DRAWINGS

Illustrative embodiments of the present disclosure are described in detail below with reference to the attached drawing figures, which are incorporated by reference herein, and wherein.

Figure 1A:
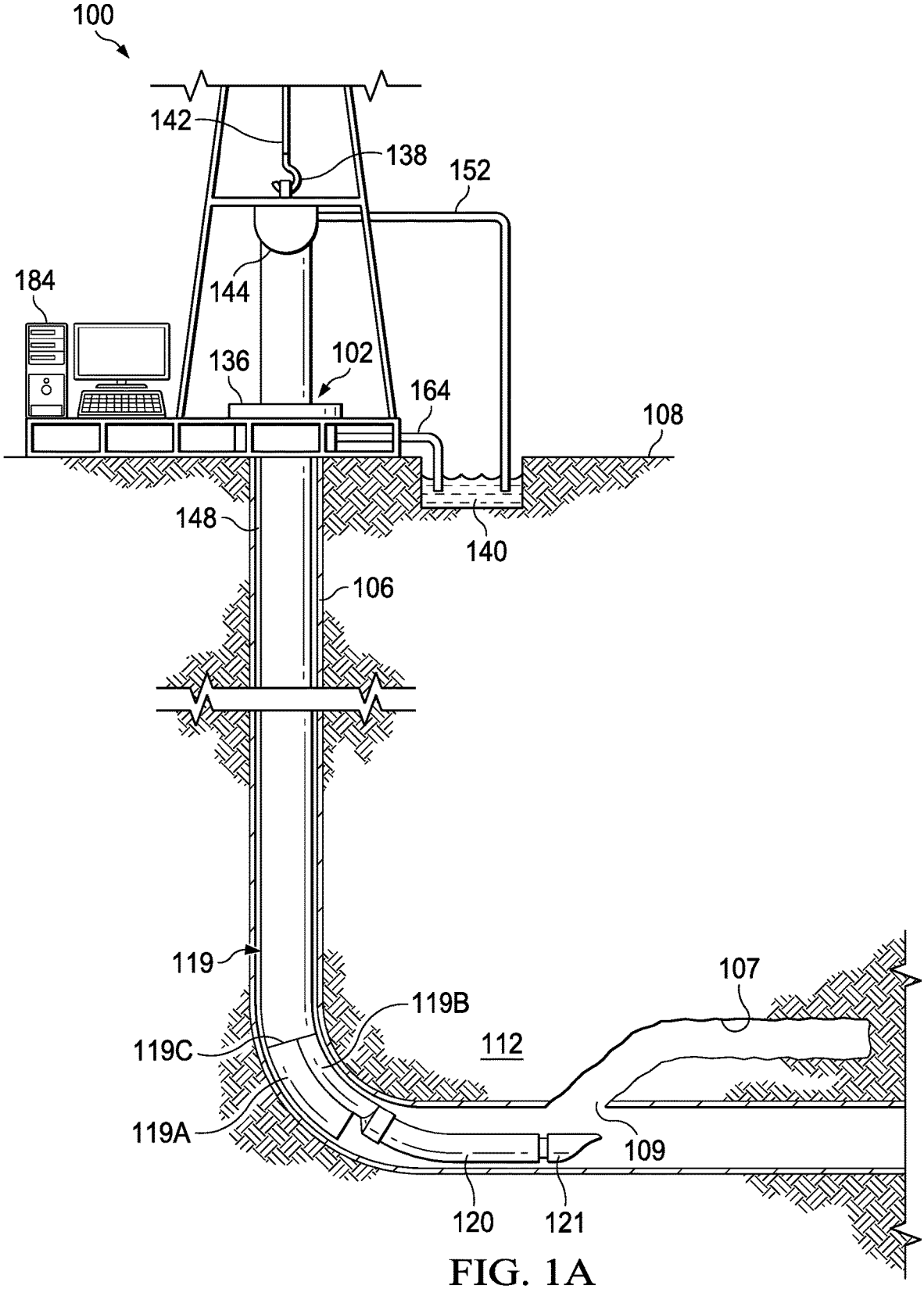
FIG. 1A is a schematic, side view of an environment in which a downhole tool that is coupled to a tubular is deployed near a window of a lateral borehole of a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to downhole tools, multi-lateral intervention systems and methods to deploy a tubular into a lateral borehole of a multi-lateral well. A multilateral intervention system includes a downhole tool coupled to a tubular that is deployable in a lateral borehole of a wellbore. As referred to herein, a tubular may be coiled tubing, drill pipe, production tubing, or another type of conveyance that has an inner diameter that forms a fluid flow path for fluids to flow downhole. The downhole tool includes a mandrel having an angulated interior profile along a first side of the mandrel and a nose (e.g., a dolphin nose, a bull nose, or another shaped nose) coupled to a second side of the mandrel. As referred to herein, an angulated profile of a component refers to a profile that is not parallel to a central axis of the component. Examples of angulated profiles, including incline profiles, decline profiles, and a combination of incline and decline profiles, are illustrated in at least FIGS. 2A-2C and are described in the paragraphs below.

The downhole tool also includes a link having an angulated exterior profile along a first side of the link that is rotatably coupled to the first side of the mandrel. As referred to herein, a link is any device or component that is rotatable from a first position to a second position, and from the second position back to the first position. In some embodiments, the link is a cylindrical cam, such as a barrel cam. Further, as referred to herein, a component is rotatably coupled to another component if the component is configured to rotate relative to the other component. For example, the link is configured to rotate in a clockwise or counterclockwise direction relative to the mandrel. Further, in some embodiments, the mandrel does not rotate while the link rotates about the mandrel. The downhole tool is actuated (e.g., electrically, mechanically, electromechanically, or hydraulically) in response to a force applied to the downhole tool, which rotates the link from a first position to a second position. As the link rotates from the first position to the second position, rotational force of the link tilts the mandrel and the nose in an upward direction, thereby tilting the nose towards a window of a lateral borehole. As referred to herein, a component is tilted relative to another component where the central axis of the component is inclined (or declined) relative to the central axis of the other component. In some embodiments, the link is configured to rotate 180° degrees in a clockwise direction to move from a first position to a second position, and the rotational force of the link tilts the mandrel and the nose approximately 10° towards the window of the lateral borehole. In some embodiments, the link is configured to rotate a different number of degrees in a clockwise direction or a counterclockwise direction. In some embodiments, rotational force of the link tilts the mandrel and the nose a different number of degrees towards the window of the lateral borehole. Additional descriptions of actuating the downhole tool to rotate the link and to tilt the mandrel and nose of the downhole tool are provided in the paragraphs below and are illustrated in at least FIGS. 2A-2B and 3A-3E.

After the nose is tilted to a desired angle of inclination (e.g. 10°), the downhole tool is actuated (e.g., electrically, mechanically, electromechanically, or hydraulically) a second time. Force applied to the downhole tool continues to rotate the link from the second position to the first position. The rotational force of the link tilts the nose of the downhole tool back towards the body to configure deployment of the downhole tool. Continuing with the foregoing example, the link is configured to rotate 180° degrees in a clockwise direction to move from the second position back to the first position, and the rotational force of the link tilts the nose of the downhole tool back towards the body of the downhole tool to align the nose with the body of the downhole tool. The downhole tool is then deployed into the lateral wellbore. Additional descriptions of downhole tools, multi-lateral intervention systems, and methods to deploy a tubular into a lateral borehole of a multi-lateral well are provided in the paragraphs below and are illustrated in the figures.

Figure 1B:
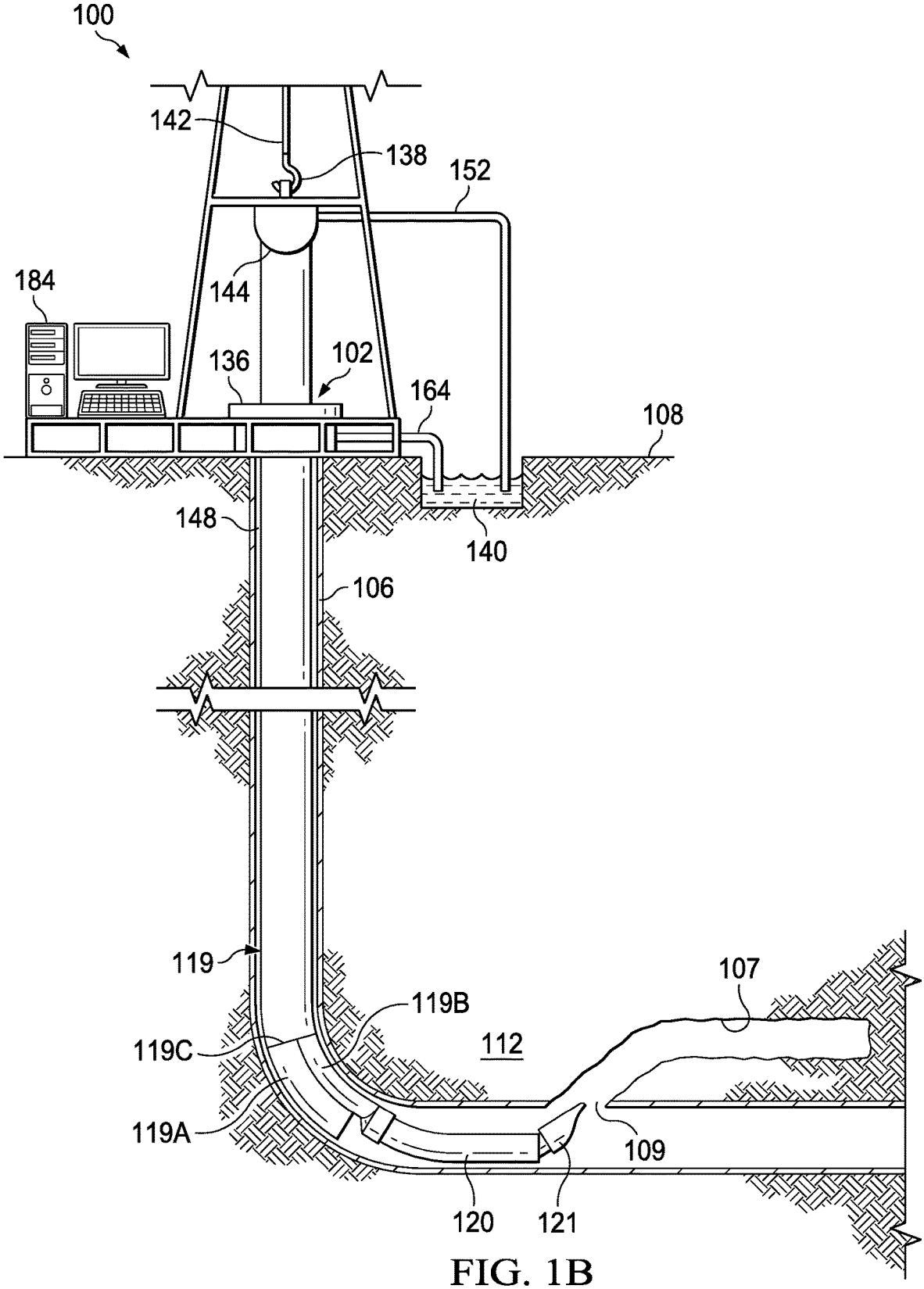
FIG. 1B is a schematic, side view of the environment of FIG. 1A, after the downhole tool is actuated to tilt a nose of the downhole tool towards the window of the lateral borehole.

Turning now to the figures, FIG. 1A is a schematic, side view of an environment 100 in which a downhole tool 120 that is coupled to a tubular 119B is deployed near a window 109 of a lateral borehole 107 of a wellbore 106. In the embodiment of FIG. 1A, a well 102 having wellbore 106 extends from a surface 108 of well 102 to or through a formation 112. Wellbore 106 includes a main borehole and lateral borehole 107 that is connected to the main borehole via window 109. A hook 138, cable 142, traveling block (not shown), hoist (not shown), and top drive 144 are provided to lower a tubular 119 down wellbore 106 of well 102 or to lift tubular 119 up from wellbore 106 of well 102. At a wellhead 136, an inlet conduit 152 is coupled to a fluid source (not shown) to provide fluids, such as drilling fluids, downhole. In the embodiment of FIGS. 1A and 1B, tubular 119 has an internal cavity that provides a fluid flow path from surface 108 to a downhole location. Tubular 119 also includes a first tubular 119A that is deployable in the main borehole, and second tubular 119B that is deployable in lateral borehole 107. Further, one end of second tubular 119B is connected to downhole tool 120 and the second end of second tubular 119B is connected to first tubular 119A at a junction 119C of tubular 119.

In some embodiments, the fluids travel down tubular 119 and exit first tubular 119A and second tubular 119B. The fluids flow back toward surface 108 through a wellbore annulus 148 and exit the wellbore annulus 148 via an outlet conduit 164 where the fluids are captured in container 140. In some embodiments, tubular 119 also provides telemetry of data indicative of one or more parameters of the well operation or the well 102.

In one or more embodiments, an acoustic telemetry system that transmits data via vibrations in the tubing wall of tubular 119 is deployed in wellbore 106 to provide telemetry. More particularly, the vibrations are generated by an acoustic transmitter (not shown) mounted on tubular 119 and propagate along tubular 119 to an acoustic receiver (not shown) also mounted on tubular 119. In one or more embodiments, an electromagnetic wave telemetry system that transmits data using current flows induced in tubular 119 is deployed in wellbore 106 to provide telemetry. Additional types of telemetry systems may also be deployed in wellbore 106 to transmit data from tool 120 and other downhole components to tubular deployment system 184.

As referred to herein, tubular deployment system 184 is any electronic device that is operable to perform operations to actuate downhole tool 120 and to deploy first tubular 119A and second tubular 119B in the main borehole and lateral borehole 107, respectively. In some embodiments, one or more processors of tubular deployment system 184 performs the operations of process 400. In the embodiment of FIGS. 1A and 1B, tubular deployment system 184 is a surface-based electronic device that includes one or more processors operable to deploy downhole tool 120 to a position near window 109. In some embodiments, tubular deployment system 184 includes one or more tubulars, such as second tubular 109B of FIGS. 1A and 1B.

A force is generated to rotate a link of downhole tool 120 from a first position to a second position. As the link rotates, the rotational force of the link tilts a nose 121 of downhole tool towards window 109. In that regard, FIG. 1B illustrates a schematic, side view of the environment of FIG. 1A, after downhole tool 120 is actuated to tilt nose 121 of downhole tool 120 towards window 109 of lateral borehole 107. Additional descriptions of the force generated to rotate the link and rotation of the link to tilt nose 121 towards window 109 are provided in the paragraphs below and are illustrated in at least FIGS. 2A-2B and 3A-3C. After nose 121 is tilted at a desired inclination relative to the body of downhole tool 120 (e.g., 10°), downhole tool 120 is actuated a second time to rotate the link from the second position to the first position. As the link rotates, the rotational force of the link nose 121 back towards the body of downhole tool 120 to configure downhole tool 120 for deployment into lateral borehole 107. Additional descriptions of the rotation of the link are provided in the paragraphs below and are illustrated in at least FIGS. 3A-3E. In some embodiments, both nose 121 and the body are tilted at approximately 10° relative to the inclination of the main borehole. Downhole tool 120 and second tubular 119B are then run into lateral borehole 107.

In some embodiments, downhole tool 120, first tubular 119A and second tubular 119B form a multi-lateral intervention system that is configured to actuate downhole tool 120, deploy first tubular 119A in the main borehole, and deploy second tubular 119B in lateral borehole 107. In one or more of such embodiments, tubular deployment system 184 is also a component of the multi-lateral intervention system.

Although FIGS. 1A and 1B illustrate one lateral borehole 107, in some embodiments, wellbore 106 includes multiple lateral boreholes (not shown). In one or more of such embodiments, multiple downhole tools coupled to multiple tubulars (not shown) that are connected at junction 119C or at one or more other junctions, are deployable at windows to the lateral boreholes. Moreover, each downhole tool of the downhole tools is configured to perform operations described herein to tilt the nose of the respective downhole tool, and to tilt the body of the respective downhole tool. Further, although tubular deployment system 184 of FIGS. 1A and 1B are illustrated as a surface-based electronic device, in some embodiments, tubular deployment system 184 is located downhole or is located in another surface-based location remote from well 102. Further, although FIGS. 1A and 1B illustrates a cased wellbore 106, in some embodiments, wellbore 106 is uncased. Similarly, although FIGS. 1A and 1B illustrate an uncased lateral borehole 107, in some embodiments, lateral borehole 107 is cased before downhole tool 120 is deployed in wellbore 106.

Figure 2A:
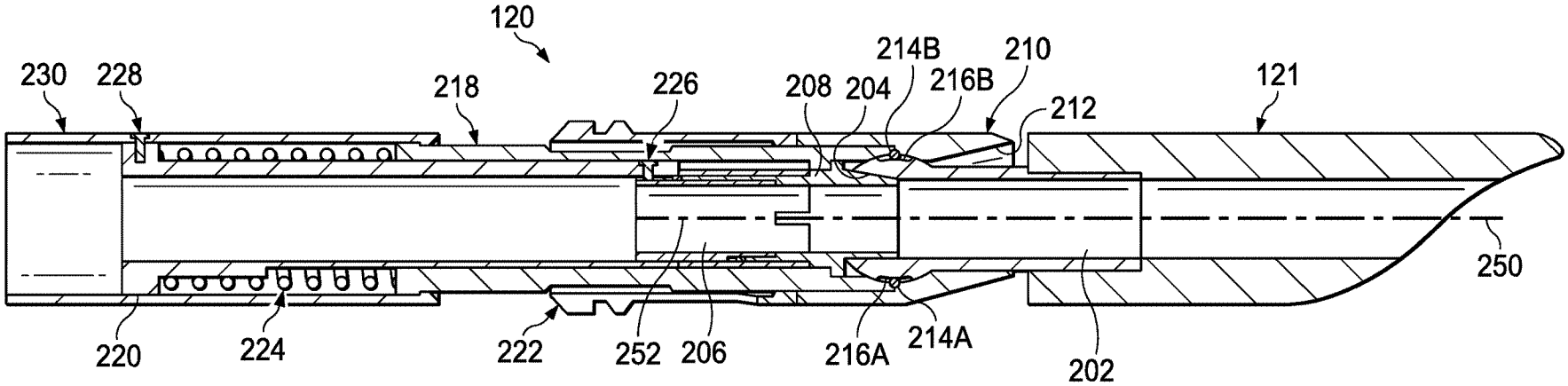
FIG. 2A is a schematic, cross-sectional view of the downhole tool of FIG. 1A before the downhole tool is actuated.

FIG. 2A is a schematic, cross-sectional view of downhole tool 120 of FIG. 1A before downhole tool 120 is actuated. Downhole tool 120 includes a mandrel 202 having an angulated interior profile 204. In the embodiment of FIG. 2A, angulated interior profile 204 is positioned on the top portion of mandrel 202 whereas the bottom portion of mandrel 202 has a relatively flat profile. Mandrel 202 is rotatably coupled to a link 206 having an angulated exterior profile 208. In the embodiment of FIG. 2A, angulated exterior profile 208 is positioned on the top portion of link 206 and adjacent to angulated interior profile 204, whereas the bottom portion of link 206 has a relatively flat surface and is positioned adjacent to the flat surface of mandrel 202. The opposing end of mandrel 202 is coupled to nose 121.

A portion of mandrel 202 is fitted within a mandrel housing 210 that has an angulated interior profile 212 positioned on the top portion of mandrel housing 210 and a relatively flat profile on the bottom portion of mandrel housing 210. In some embodiments, angulated interior profile 212 provides spacing to allow mandrel 202 to tilt at a desired incline angle relative to link 206. The exterior surface of mandrel 202 has longitudinal grooves 216A and 216B. Balls bearings 214A and 214B are positioned between longitudinal grooves 216A and 216B and mandrel housing 210. The ball bearings 214A and 214B and longitudinal grooves 216A and 216B restrict rotational movement of mandrel 202 while permitting tilting of mandrel 202. In the embodiment of FIG. 2A, the central axis of mandrel 202 and nose 121, which is represented by line 250 is parallel or approximately parallel to the central axis of link 206 and mandrel housing 210, which is represented by line 252.

Figure 2B:
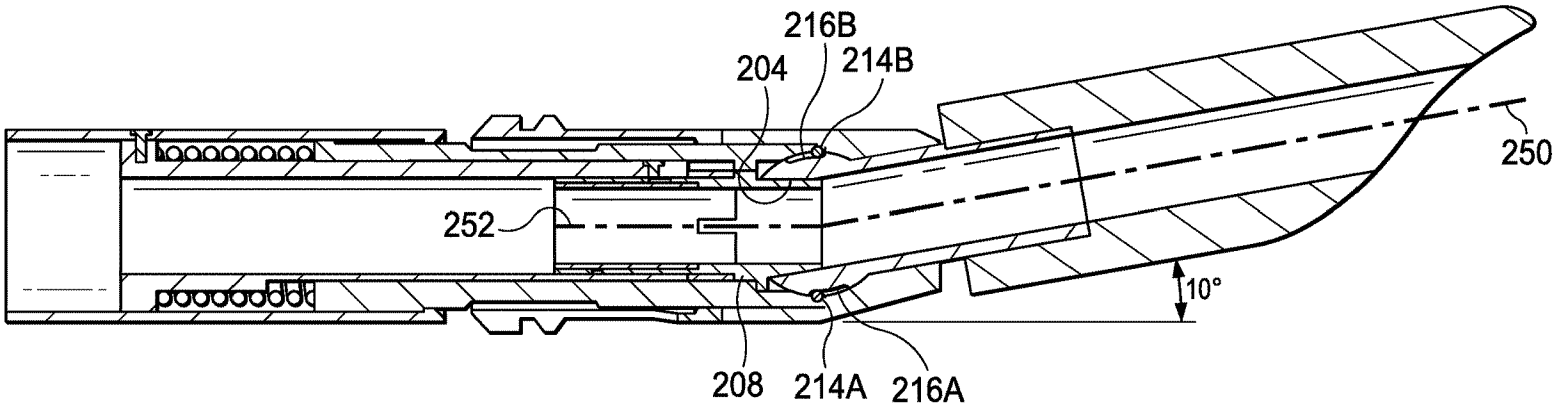
FIG. 2B is a schematic, cross-sectional view of the downhole tool of FIG. 2A after the downhole tool is actuated to tilt the nose of the downhole tool.
Figure 2C:
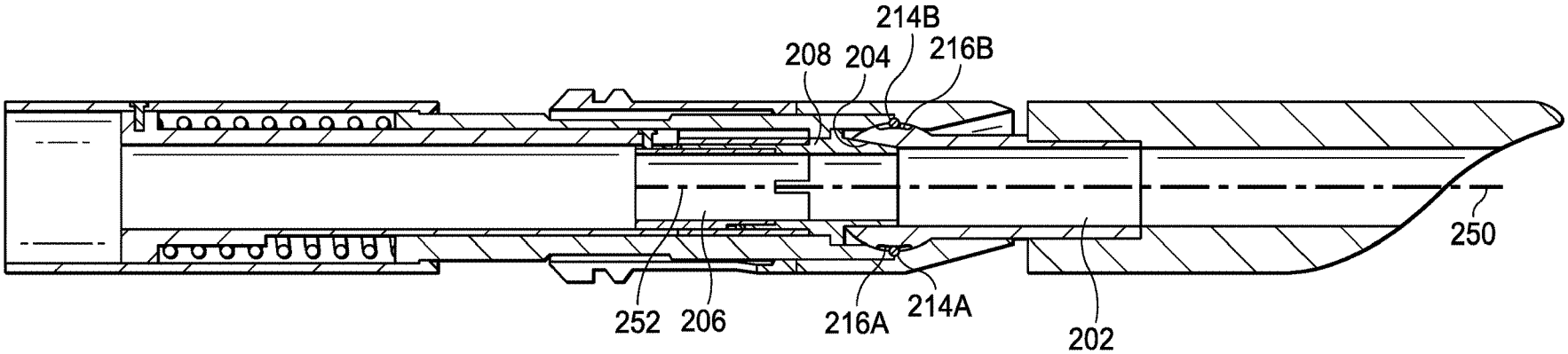
FIG. 2C is a schematic, cross-sectional view of the downhole tool of FIG. 2B after the downhole tool is actuated a second time to tilt the nose of the downhole tool towards the body of the downhole tool.

A second mandrel 220 having a pin 226 fastened to a wall of second mandrel 220 is rotatably coupled to a second side of link 206. Moreover, pin 226 fits within a groove that extends along the exterior surface of link 206. FIGS. 3A-3E illustrate the groove of link 206 and movement of pin 226 within the groove of link 206 while link 206 rotates from a first position to a second position, and from the second position back to the first position. Link 206 is positioned within a link housing 218 that also partially houses second mandrel 220. In the embodiments of FIGS. 2A-2C, link housing 218 has an interior profile that matches an exterior profile of second mandrel 220 to allow lateral (forward towards link 206 and backward away from link 206) movement of second mandrel 220 but prevent rotational movement of second mandrel 220 with respect to link housing 218 or link 206. Housing 230 houses a second portion of second mandrel 220. In some embodiments, housing 230 also houses an actuation device (e.g., a piston) that is operable to generate a stroke (force) to thrust second mandrel 220 forward, thereby actuating downhole tool 120. In one or more of such embodiments, the actuation force is generated electrically, mechanically, or hydraulically. A pin 228 is fastened to second mandrel 220 to prevent movement of second mandrel 220 with respect to housing 230. Although FIG. 2A illustrates a single pin 228, in some embodiments, multiple pins are fastened to second mandrel 220 to prevent movement of second mandrel 220 with respect to housing 230. A coiled spring 224 is placed between second mandrel 220 and link housing 218 and is configured to compress to store the actuation fore and un-compress to release the actuation force to rotate link 206 from a position illustrated in FIG. 2A to a position illustrated in FIG. 2B, and from the position illustrated in FIG. 2B back to the position illustrated in FIG. 2A. Downhole tool 120 also includes a collapsible gauge 222, which is configured to expand to prevent forward movement of downhole tool 120 in a borehole while collapsible gauge 222 is in an expanded position, and is configured to collapse to allow forward movement of downhole tool 120. In the embodiment of FIG. 2A, collapsible gauge 222 is in an expanded position, which prevents forward movement of downhole tool 120. Further, in the embodiment of FIGS. 2A-2C, collapsible gauge 222 is a collet. An actuation force described herein and applied to second mandrel 220 and coil spring 224 is transferred to collapsible gauge 222, thereby collapsing collapsible gauge 222, and allowing forward movement of downhole tool 120 (e.g., through window 109 of FIGS. 1A and 1B and into lateral borehole 107). The actuation force also drives second mandrel 220 and pin 226 forward towards nose 121, and moves the position of pin 226 in the groove of link 206. Movement of pin 226 in the groove of link 206 rotates link 206, which in turn tilts mandrel 202 and nose 121.

FIG. 2B is a schematic, cross-sectional view of downhole tool 120 of FIG. 2A after downhole tool 120 is actuated to tilt nose 121 of downhole tool 120. In the embodiment of FIG. 2B, link 206 has rotated approximately 180° relative to the position of link 206 in FIG. 2A, such that angulated exterior profile 208 of link 206 is positioned on the bottom portion of link 206 while angulated interior profile 204 of mandrel 202 remains positioned on the top portion of mandrel 202. Moreover, ball bearings 214A and 214B have shifted in opposing longitudinal directions within longitudinal grooves 216A and 216B, respectively to allow mandrel 202 and nose 121 to tilt while preventing mandrel 202 from rotating while link 206 rotates from the first position illustrated in FIG. 2A to the second position illustrated in FIG. 2B. In the embodiment of FIG. 2B, mandrel 202 and nose 121 have tilted approximately 10° relative to the body of downhole tool 120, which includes link 206, link housing 218, mandrel housing 210, collapsible gauge 222, second mandrel 220, and housing 230. More particularly, the central axis of mandrel 202 and nose 121, which is represented by line 250 is tilted approximately 10° relative to the central axis of link 206 and mandrel housing 210, which is represented by line 252.

FIG. 2C is a schematic, cross-sectional view of downhole tool 120 of FIG. 2B after downhole tool 120 is actuated a second time to tilt the mandrel 202 and nose 121 approximately or equal to 0° relative to the body of downhole tool 120. In the embodiment of FIG. 2C, link has 206 rotated approximately 180° relative to the position of link 206 in FIG. 2B, such that angulated exterior profile 208 of link 206 is positioned on the top portion of link 206 while angulated interior profile 204 of mandrel 202 remains positioned on the top portion of mandrel 202. Moreover, ball bearings 214A and 214B have shifted to positions within longitudinal grooves 216A and 216B similar to positions of ball bearings 214A and 214B as illustrated in FIG. 2A, respectively to allow the body of downhole tool 120 to tilt the body of downhole tool 120 relative to the main borehole of FIGS. 1A and 1B while preventing mandrel 202 from rotating while link 206 rotates from the second position illustrated in FIG. 2B back to the first position illustrated in FIG. 2C. In the embodiment of FIG. 2C, the central axis of mandrel 202 and nose 121, which is represented by line 250, is approximately parallel to the central axis of link 206 and mandrel housing 210, which is represented by line 252. In some embodiments, while collapsible gauge 222 is in an collapsed state (e.g., due to actuation of downhole tool 120) a force generated by top drive 144 of FIGS. 1A and 1B drives conveyance 119B and downhole tool 120 towards and into lateral borehole 107. Downhole tool 120 is then deployed into lateral borehole 107 of FIGS. 1A and 1B.

In the embodiments of FIGS. 2A-2C, tool 120 has an interior passage that provides a fluid passage for fluids to flow through the interior passage. More particularly, nose 121, mandrel 202, and each component of the body of downhole tool 120 are hollow to provide fluid flow through the respective components. In some embodiments, the interior of nose 121, mandrel 202, and each component of the body of downhole tool 120 have an interior diameter greater than a threshold length (e.g., 1 inch, 2 inches, 3 inches, or another length) to allow solid particles and components (e.g., balls and diverters) to pass through the body, mandrel 202, and nose 121 of downhole tool 120. More particularly, the interiors of the components of the body of downhole tool 120 are in fluid communication with each other. Although the foregoing paragraphs describe rotating link 206 180° or approximately 180° from the first position as shown in FIG. 2A to the position as shown in FIG. 2B, and to rotating link 206 another 180° or approximately 180° from the position illustrated in FIG. 2B to the position illustrated in FIG. 2C, in some embodiments, link 206 is rotated a different number of degrees from the position illustrated in FIG. 2A to the position illustrated in FIG. 2B, and from position illustrated in FIG. 2B to the position illustrated in FIG. 2C. Further, although the foregoing paragraphs describe tilting mandrel 202 and nose 121 10°, followed by tilting mandrel 202 and nose 121 by 10° back towards the body of downhole tool 120, in some embodiments, mandrel 202, and nose 121 are tilted by a different number of degrees. In such embodiments, angulated interior profiles 204 and 212, and angulated exterior profile 208 are configured to permit the desired rotation of link 206 and tilt of mandrel 202 and nose 121 of downhole tool 120. Further, although FIGS. 2A-2C illustrate the central axis of mandrel 202 and body 121 as aligned at line 250, in some embodiments, mandrel 202 and body 121 have different central axes that are not aligned but are parallel or substantially parallel to each other. Similarly, although FIGS. 2A-2C illustrate the central axis of different components of the body of downhole tool 120 as being aligned at line 252, in some embodiments, different components (e.g., link 206 and mandrel housing 210) have different axes that are not aligned but are parallel or substantially parallel to each other.

Figure 3A:
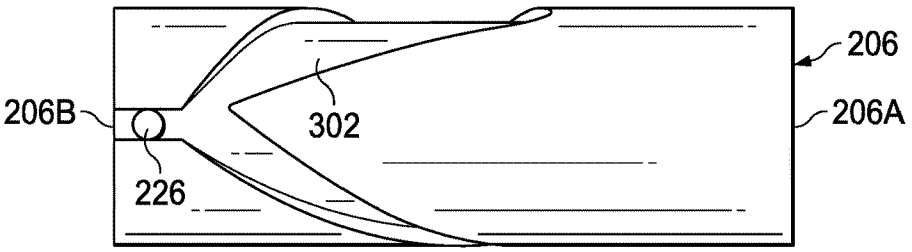
FIG. 3A is a schematic side view of a groove on an exterior surface of the link of FIG. 2A while the downhole tool is in a position illustrated in FIG. 2A.

FIG. 3A is a schematic side view of a groove 302 on an exterior surface of link 206 of FIG. 2A while downhole tool 120 of FIGS. 2A-2C is in a position illustrated in FIG. 2A. As illustrated in FIG. 3A, pin 226 is positioned within groove 302. Further, collapsible gauge 222 of FIGS. 2A-2C is in an expanded position as illustrated in FIG. 2A. As downhole tool 120 is actuated, second mandrel 220 of FIG. 2A, which pin 226 is fixed attached to, is thrust forward towards a front side 206A of link 206, thereby also moving the position of pin 226 relative to link 206. More particularly, pin 226 moves from a position closer to back side 206B of link 206 towards a position closer to front side 206A of link 206 while remaining in groove 302. Movement of pin 226 within the profile of groove 302 rotates link 206 from the first position illustrated in FIG. 2A towards the second position illustrated in FIG. 2B.

Figure 3B:
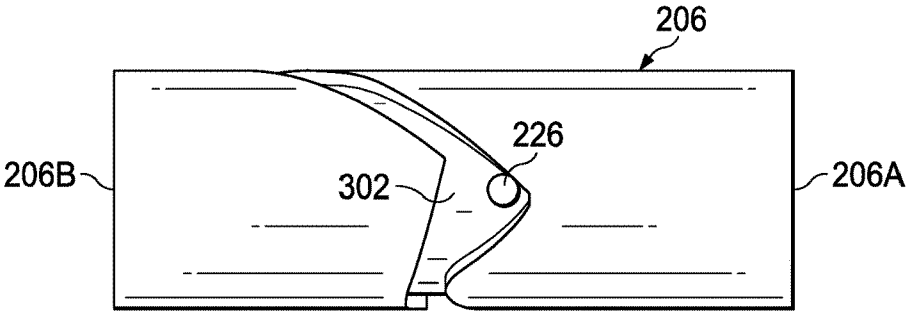
FIG. 3B is a schematic side view of the groove on the exterior surface of the link while the link rotates between from the position illustrated in FIG. 2A to a position illustrated in FIG. 2B.

FIG. 3B is a schematic side view of groove 302 on the exterior surface of link 206 while link 206 rotates between from the position illustrated in FIG. 2A to a position illustrated in FIG. 2B. As shown in FIG. 3B, pin 226 has moved to a position closer to front side 206A of link 206. In the embodiment of FIG. 3B, actuation of downhole tool 120 also collapses collapsible gauge 222 of FIG. 2A, thereby allowing movement of downhole tool 120 of FIG. 2A. Further, movement of pin 226 within groove 302 has rotated link 206 approximately 111° relative to the position of link 206 as illustrated in FIGS. 2A and 3A. As link 206 rotates from the first position illustrated in FIG. 2A towards the second position illustrated in FIG. 2B, rotation of angulated exterior profile 208 of link 206 as shown in FIGS. 2A-2C with respect to angulated interior profile 204 of mandrel 202 as shown in FIGS. 2A-2C tilts mandrel 202 and nose 121 of FIGS. 2A-2C. In the embodiment of FIG. 2B, an approximately 111° rotation of link 206 from the first position illustrated in FIG. 2A towards the second position illustrated in FIG. 2B tilts mandrel 202 and nose 121 approximately 7°. In some embodiments, link 206 rotates a different number of degrees to tilt mandrel 202 and nose 121 a different number of degrees towards window 109 of FIGS. 1A and 1B. Further movement of pin 226 within groove 302 continues to rotate link 206 towards the second position illustrated in FIG. 2B.

Figure 3C:
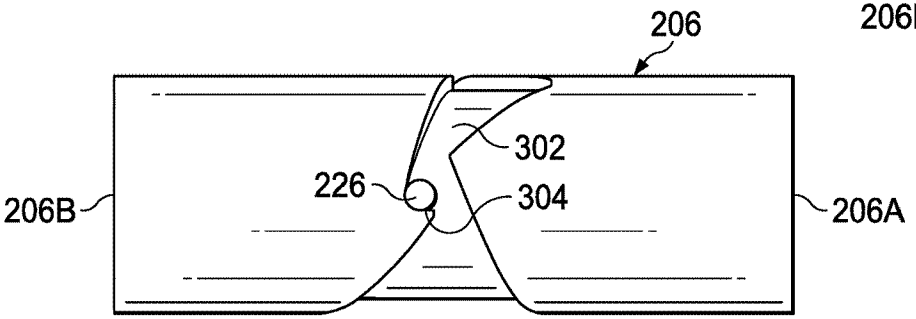
FIG. 3C is a schematic side view of the groove on the exterior surface of the link while the downhole tool is in the position illustrated in FIG. 2B.

FIG. 3C is a schematic side view of groove 302 on the exterior surface of link 206 while downhole tool 120 of FIGS. 2A-2C is in the second position illustrated in FIG. 2B. More particularly, pin 226 has moved to a position illustrated in FIG. 3C after the first actuation of downhole tool 120. As shown in FIG. 3C, pin 226 has landed in a region 304 of groove 302 that locks pin 226 in region 304 and prevents additional movement of pin 226 within groove 302 if a second actuation force (generated by a second actuation of downhole tool 120) is not exerted against second mandrel 220 of FIGS. 2A-2C. Further, movement of pin 226 from the position illustrated in FIG. 3A to the position illustrated in FIG. 3C rotates link 206 to the position illustrated in FIG. 2B, which is approximately 180° relative to the position of link 206 as illustrated in FIGS. 2A and 3A. As link 206 rotates from the position illustrated in FIG. 3B towards the second position illustrated in FIGS. 2B and 3C, rotation of angulated exterior profile 208 of link 206 as shown in FIGS. 2A-2C with respect to angulated interior profile 204 of mandrel 202 as shown in FIGS. 2A-2C further tilts mandrel 202 and nose 121 of FIGS. 2A-2C. In the embodiment of FIG. 3C, an approximately 180° rotation of link 206 from the first position illustrated in FIG. 2A towards the second position illustrated in FIG. 2B tilts mandrel 202 and nose 121 approximately 10°. In some embodiments, link 206 rotates a different number of degrees to tilt mandrel 202 and nose 121 a different number of degrees towards window 109 of FIGS. 1A and 1B.

Figure 3D:
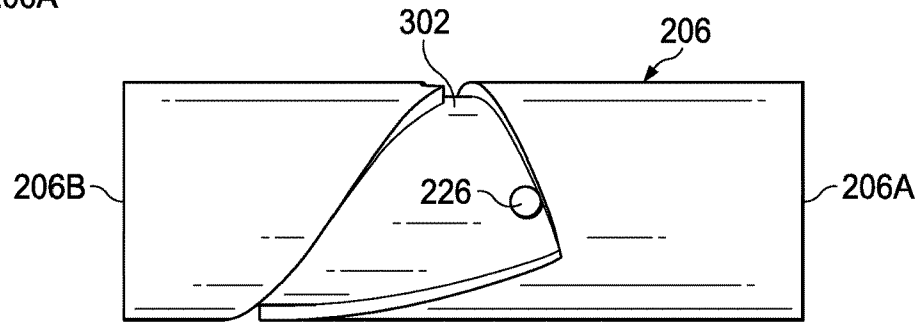
FIG. 3D is a schematic side view of the groove on the exterior surface of the link while the link rotates from the position illustrated in FIG. 2B to a position illustrated in FIG. 2C.

A second actuation force generated by a second actuation of downhole tool 120 dislodges pin 226 from region 304, thereby allowing link 206 to continue to rotate from the second position illustrated in FIG. 2B back to the first position illustrated in FIGS. 2A and 2C. FIG. 3D is a schematic side view of groove 302 on the exterior surface of link 206 while link 206 rotates from the position illustrated in FIG. 2B to a position illustrated in FIG. 2C. As shown in FIG. 3D, pin 226 has moved from the position illustrated in FIG. 3C closer to front side 206A of link 206. Further, movement of pin 226 within groove 302 has rotated link 206 approximately 286° relative to the position of link 206 as illustrated in FIGS. 2A and 3A. As link 206 rotates from the second position illustrated in FIG. 2B towards the first position illustrated in FIG. 2C, rotation of angulated exterior profile 208 of link 206 as shown in FIGS. 2A-2C with respect to angulated interior profile 204 of mandrel 202 as shown in FIGS. 2A-2C tilts the mandrel 202 and nose 121 of FIGS. 2A-2C back towards the body of downhole tool 120 of FIGS. 2A-2C. In the embodiment of FIG. 2D, an approximately 286° rotation of link 206 from the first position illustrated in FIG. 2A towards the position illustrated in FIG. 3D tilts mandrel 202 and nose 121 of downhole tool 120 to approximately 4° relative to the body of downhole tool 120. In some embodiments, link 206 rotates a different number of degrees to tilt mandrel 202 and nose 121 of downhole tool 120 a different number of degrees towards the body of downhole tool 120. Further movement of pin 226 within groove 302 continues to rotate link 206 towards the first position illustrated in FIG. 2C.

Figure 3E:
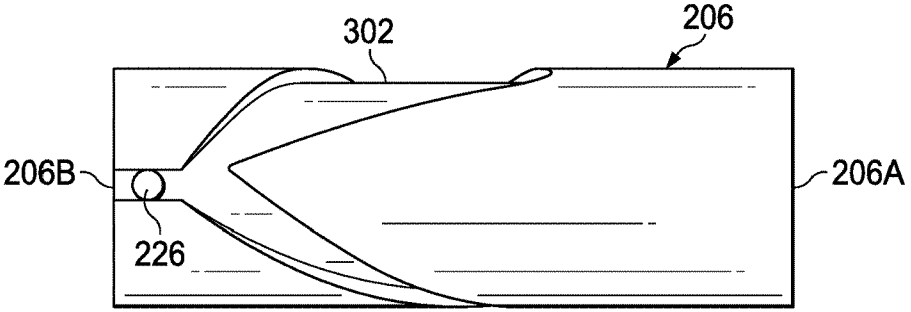
FIG. 3E is a schematic side view of the groove on the exterior surface of the link while the downhole tool is in the position illustrated in FIG. 2C.

FIG. 3E is a schematic side view of groove 302 on the exterior surface of link 206 while downhole tool 120 is in the position illustrated in FIG. 2C. More particularly, pin 226 has moved to a position illustrated in FIG. 3E after the second actuation of downhole tool 120. As shown in FIG. 3E, pin 226 has returned to the same region of groove 302 illustrated in FIG. 3A. Further, movement of pin 226 from the position illustrated in FIG. 3A to the position illustrated in FIG. 3E rotates link 206 to the position illustrated in FIG. 2C, which is approximately a full revolution (360° or 0°) relative to the position of link 206 as illustrated in FIGS. 2A and 3A. As link 206 rotates from the second position illustrated in FIG. 3D towards the first position illustrated in FIGS. 2A and 2C, rotation of angulated exterior profile 208 of link 206 as illustrated in FIGS. 2A-2C with respect to angulated interior profile 204 of mandrel 202 as illustrated in FIGS. 2A-2C further tilts mandrel 202 and head 121 of downhole tool 120 towards the body of downhole tool 120 of FIGS. 2A-2C. In the embodiment of FIG. 3C, an approximately 180° rotation of link 206 from the second position illustrated in FIG. 2B to the first position illustrated in FIG. 2C also returns mandrel 202 and nose 121 of downhole tool 120 to their original orientations relative to the body of downhole tool 120 as shown in FIGS. 2A and 2C, where the central axis of mandrel 202, nose 121 and the body of downhole tool 120 are aligned or are approximately parallel. In some embodiments, link 206 rotates a different number of degrees to tilt mandrel 202 and nose 121 a different number of degrees towards the body of downhole tool 120. In some embodiments, the second actuation of downhole tool 120 also expands collapsible gauge 222 of FIGS. 2A-2C, thereby allowing deployment of downhole tool 120 into lateral borehole 107 of FIGS. 1A and 1B. In some embodiments, groove 302 has a different profile than the profile illustrated in FIGS. 3A-3E. In some embodiments, multiple pins (not shown) are positioned in groove 302 to guide rotation of link 206.

Figure 4:
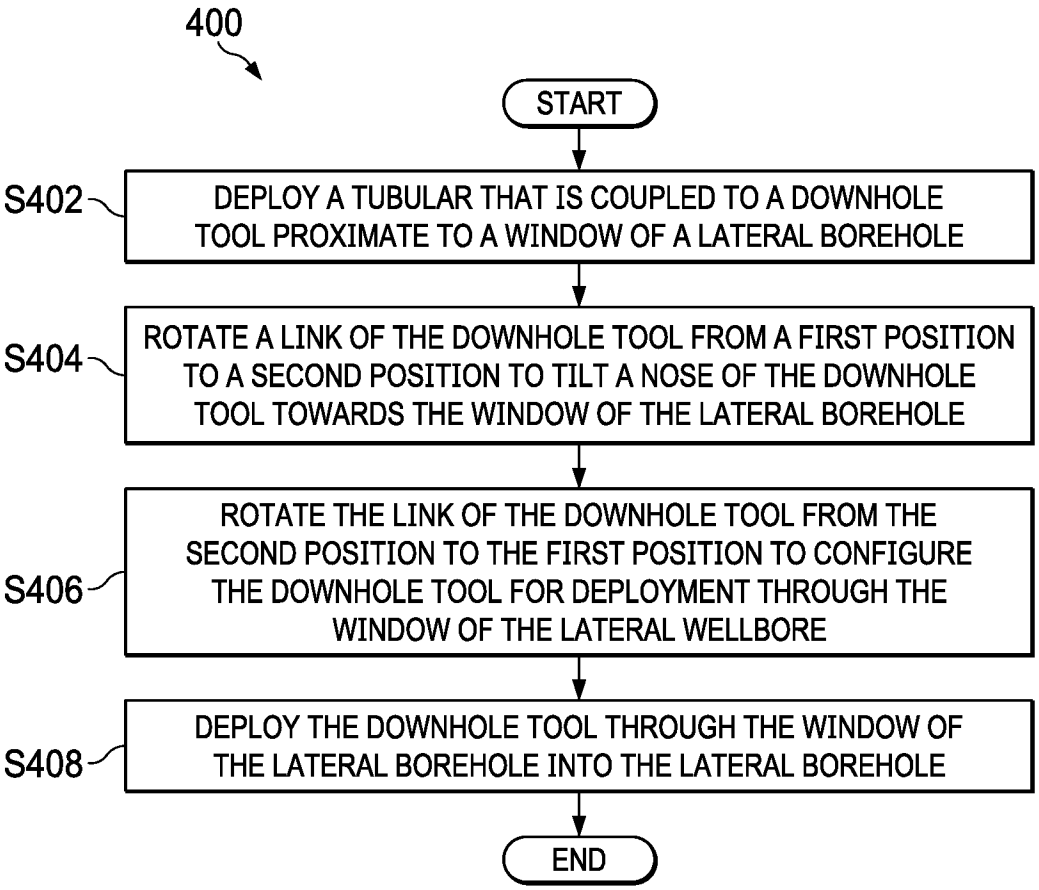
FIG. 4 is a flow chart of a process to deploy a tubular into a lateral borehole of a multi-lateral well.

FIG. 4 is a flow chart of a process 400 to deploy a tubular into a lateral borehole of a multi-lateral well. Although the operations in the process 400 are shown in a particular sequence, certain operations may be performed in different sequences or at the same time where feasible.

At block S402, a tubular that is coupled to a downhole tool is deployed proximate to a window of a lateral borehole. FIG. 1A, for example, illustrates deploying downhole tool 120 that is coupled to tubular 119B near window 109 of lateral wellbore 107. At block S404, a link of the downhole tool is rotated from a first position to a second position to tilt a nose of the downhole tool towards the window of the lateral borehole. FIGS. 2A-2B, for example, illustrate rotating link 206 approximately 180° to tilt mandrel 202 and nose 121 approximately 10° towards window 109 of lateral wellbore 107 of FIGS. 1A and 1B. Moreover, FIGS. 3A-3C illustrate movement of pin 226 within groove 302 of link 206 to rotate link 206 from the first position illustrated in FIG. 2A to the second position illustrated in FIG. 2B. In some embodiments, a first stroke is generated to actuate downhole tool 120. In one or more of such embodiments, the first stoke is generated electrically (e.g., by a power source). In one or more of such embodiments, the first stroke is generated mechanically. In one or more of such embodiments, the first stroke is generated hydraulically. Additional descriptions of actuating downhole tool 120 to generate an actuation force and to rotate link 206 are provided herein and are illustrated in at least FIGS. 2A-2B and 3A-3C.

A second stroke is generated to actuate downhole tool 120 a second time. In some embodiments, the second stoke is generated electrically (e.g., by a power source). In some embodiments, the second stroke is generated mechanically. In some embodiments, the second stroke is generated hydraulically. The second actuation of downhole 120 collapses collapsible gauge 222, thereby allowing forward motion of downhole tool 120. At block S406, the link of the downhole tool is rotated from the second position to the first position to configure the downhole tool for deployment through the window of the lateral wellbore. More particularly, downhole tool 120 is reconfigured to its original configuration as shown in FIG. 2A, where mandrel 202 and nose 121 of downhole tool 120 as shown in FIG. 2A align or are approximately parallel to the body of downhole tool 120, thereby allowing or facilitating deployment of downhole tool 120 through the window of the lateral borehole, and into the lateral wellbore. In that regard, FIGS. 2B-2C illustrate rotating link 206 approximately 180° to tilt mandrel 202 and nose 121 of downhole tool 120 back towards the body of downhole tool 120. Moreover, FIGS. 3C-3E illustrate movement of pin 226 within groove 302 of link 206 to rotate link 206 from the second position illustrated in FIG. 2B to the first position illustrated in FIG. 2C. Additional descriptions of actuating downhole tool 120 a second time to generate a second actuation force and to rotate link 206 are provided herein and are illustrated in at least FIGS. 2B-2C and 3C-3E.

At block S408, the downhole tool is deployed through the window of the lateral borehole into the lateral borehole. In some embodiments, downhole tool 120 and tubular 119B are deployed through window 109 into lateral wellbore 107 of FIGS. 1A and 1B. In some embodiments, one or more operations performed at blocks S402, S404, S406, and S408 are performed by tubular deployment system 184 of FIGS. 1A and 1B. In one or more of such embodiments, one or more processors of tubular deployment system 184 are operable to perform the operations described herein to deploy a tubular, such as tubular 109B into a lateral borehole of a multi-lateral well, such as lateral borehole 107 of well 106 of FIGS. 1A and 1B.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a downhole tool, comprising: a mandrel having an angulated interior profile along a first side of the mandrel; a nose coupled to a second side of the mandrel; and a link having an angulated exterior profile along a first side of the link that is rotatably coupled to the first side of the mandrel, wherein the link is rotatable from a first position to a second position, and wherein the nose tilts at an angle relative to the link while the link is at the second position.

Clause 2, the downhole tool of clause 1, wherein the link is rotatable from the second position to the first position, and wherein a central axis of the link and a central axis of the nose are approximately parallel while the link is in the first position.

Clause 3, the downhole tool of clause 2, wherein the link is configured to rotate approximately 180° to rotate from the first position to the second position, and wherein the link is configured to rotate approximately 180° to rotate from the second position to the first position.

Clause 4, the downhole tool of clause 3, wherein the nose tilts at an approximately 10° angle relative to the link while the link is at the second position.

Clause 5, the downhole tool of any of clauses 1-4, further comprising a mandrel housing that houses the mandrel and having a second angulated interior profile, wherein the mandrel is configured to tilt within the mandrel housing while the link is rotated from the first position to the second position.

Clause 6, the downhole tool of clause 5, wherein a central axis the mandrel housing and a central axis of the mandrel are approximately parallel while the link is in the first position, and wherein the mandrel is tilted at the angle relative to the mandrel housing while the link is in the second position.

Clause 7, the downhole tool of any of clauses 1-6, further comprising: a second mandrel that is rotatably coupled to a second side of the link; and a link housing that houses the link and a portion of the second mandrel.

Clause 8, the downhole tool of clause 7, wherein the link housing comprises an interior profile that matches an exterior profile of the second mandrel to prevent rotation of the second mandrel with respect to the link housing.

Clause 9, the downhole tool of any of clauses 1-8, further comprising a coil spring positioned between the link housing and a second portion of the second mandrel, wherein the coil spring is configured to release a force to rotate the link from the first position to the second position.

Clause 10, the downhole tool of any of clauses 1-9, wherein the coil spring is configured to release a second force to rotate the link from the second position to the first position.

Clause 11, the downhole tool of any of clauses 1-10, further comprising a collapsible gauge configured to prevent forward movement of the downhole tool while the collapsible gauge is in an expanded position.

Clause 12, the downhole tool of any of clauses 1-11, wherein interiors of the link, the mandrel, and the nose are in fluid communication with each other.

Clause 13, the downhole tool of any of clauses 1-12, wherein the link is a barrel cam.

Clause 14, a multi-lateral intervention system, comprising: a first tubular deployable in a main borehole; a second tubular deployable in a lateral borehole and having a first segment that is coupled to the first tubular; and a downhole tool that is coupled to a second segment of the second tubular, and comprising: a mandrel having an angulated interior profile along a first side of the mandrel; a nose coupled to a second side of the mandrel; and a link having an angulated exterior profile along a first side of the link that is rotatably coupled to the first side of the mandrel, wherein the link is rotatable from a first position to a second position, and wherein the nose tilts at an angle relative to the link while the link is at the second position.

Clause 15, the multi-lateral intervention system of clause 14, wherein the link is rotatable from the second position to the first position, and wherein a central axis of the link and a central axis of the nose are approximately parallel while the link is in the first position.

Clause 16, the multi-lateral intervention system of clause 15, wherein the link is configured to rotate approximately 180° to rotate from the first position to the second position, and wherein the link is configured to rotate approximately 180° to rotate from the second position to the first position.

Clause 17, the multi-lateral intervention system of clause 16, wherein the nose tilts at an approximately 10° angle relative to the link while the link is at the second position.

Clause 18, a method to deploy a tubular into a lateral borehole of a multi-lateral well, the method comprising: deploying a tubular that is coupled to a downhole tool proximate to a window of a lateral borehole; rotating a link of the downhole tool from a first position to a second position to tilt a nose of the downhole tool towards the window of the lateral borehole; rotating the link from the second position to the first position to configure the downhole tool for deployment through the window of the lateral borehole; and deploying the downhole tool through the window of the lateral borehole into the lateral borehole.

Clause 19, the method of clause 18, further comprising: generating a first stroke to rotate the link from the first position to the second position; and generating a second stroke to rotate the link from the second position to the first position.

Clause 20, the method of clauses 18 or 19, wherein rotating the link from the first position to the second position comprises rotating the link approximately 180° in a first direction, and wherein rotating the link from the second position to the first position comprises rotating the link approximately 180° in the first direction.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A downhole tool, comprising:

a mandrel having an angulated interior profile along a first side of the mandrel;

a nose coupled to a second side of the mandrel;

a collapsible gauge configured to prevent forward movement of the downhole tool while the collapsible gauge is in an expanded position; and a link having an angulated exterior profile along a first side of the link that is rotatably coupled to the first side of the mandrel, wherein the link is rotatable from a first position to a second position, and wherein the nose tilts at an angle relative to the link while the link is at the second position.

2. The downhole tool of claim 1, wherein the link is rotatable from the second position to the first position, and wherein a central axis of the link and a central axis of the nose are parallel while the link is in the first position.

3. The downhole tool of claim 2, wherein the link is configured to rotate 180° to rotate from the first position to the second position, and wherein the link is configured to rotate 180° to rotate from the second position to the first position.

4. The downhole tool of claim 3, wherein the nose tilts at a 10° angle relative to the link while the link is at the second position.

5. The downhole tool of claim 1, further comprising a mandrel housing that houses the mandrel and having a second angulated interior profile, wherein the mandrel is configured to tilt within the mandrel housing while the link is rotated from the first position to the second position.

6. The downhole tool of claim 5, wherein a central axis the mandrel housing and a central axis of the mandrel are parallel while the link is in the first position, and wherein the mandrel is tilted at the angle relative to the mandrel housing while the link is in the second position.

7. The downhole tool of claim 1, further comprising:

a second mandrel that is rotatably coupled to a second side of the link; and a link housing that houses the link and a portion of the second mandrel.

8. The downhole tool of claim 7, wherein the link housing comprises an interior profile that matches an exterior profile of the second mandrel to prevent rotation of the second mandrel with respect to the link housing.

9. The downhole tool of claim 1, further comprising a coil spring positioned between the link housing and a second portion of a second mandrel, wherein the coil spring is configured to release a force to rotate the link from the first position to the second position.

10. The downhole tool of claim 9, wherein the coil spring is configured to release a second force to rotate the link from the second position to the first position.

11. The downhole tool of claim 1, wherein interiors of the link, the mandrel, and the nose are in fluid communication with each other.

12. The downhole tool of claim 1, wherein the link is a barrel cam.

13. A multi-lateral intervention system, comprising:

a first tubular deployable in a main borehole;

a second tubular deployable in a lateral borehole and having a first segment that is coupled to the first tubular; and a downhole tool that is coupled to a second segment of the second tubular, and comprising:

a mandrel having an angulated interior profile along a first side of the mandrel;

a nose coupled to a second side of the mandrel;

a collapsible gauge configured to prevent forward movement of the downhole tool while the collapsible gauge is in an expanded position; and a link having an angulated exterior profile along a first side of the link that is rotatably coupled to the first side of the mandrel, wherein the link is rotatable from a first position to a second position, and wherein the nose tilts at an angle relative to the link while the link is at the second position.

14. The multi-lateral intervention system of claim 13, wherein the link is rotatable from the second position to the first position, and wherein a central axis of the link and a central axis of the nose are parallel while the link is in the first position.

15. The multi-lateral intervention system of claim 14, wherein the link is configured to rotate 180° to rotate from the first position to the second position, and wherein the link is configured to rotate 180° to rotate from the second position to the first position.

16. The multi-lateral intervention system of claim 15, wherein the nose tilts at a 10° angle relative to the link while the link is at the second position.

17. A method to deploy a tubular into a lateral borehole of a multi-lateral well, the method comprising:

deploying a tubular that is coupled to a downhole tool proximate to a window of a lateral borehole;

engaging a collapsible gauge to prevent forward movement of the downhole tool while the collapsible gauge is in an expanded position;

rotating a link of the downhole tool from a first position to a second position to tilt a nose of the downhole tool towards the window of the lateral borehole;

rotating the link from the second position to the first position to configure the downhole tool for deployment through the window of the lateral borehole; and deploying the downhole tool through the window of the lateral borehole into the lateral borehole.

18. The method of claim 17, further comprising:

generating a first stroke to rotate the link from the first position to the second position; and generating a second stroke to rotate the link from the second position to the first position.

19. The method of claim 17, wherein rotating the link from the first position to the second position comprises rotating the link 180° in a first direction, and wherein rotating the link from the second position to the first position comprises rotating the link 180° in the first direction.

* * * * *